United States Patent [19]

Terzian et al.

[11] Patent Number: 4,507,098

[45] Date of Patent: Mar. 26, 1985

[54] SKATING DOLL WITH LEGS HAVING ANGLED PIVOT AXES

[75] Inventors: Rouben T. Terzian, Chicago; Horst-Dieter Herbstler, Bolingbrook, both of Ill.

[73] Assignee: Marvin Glass & Associates, Chicago, Ill.

[21] Appl. No.: 443,484

[22] Filed: Nov. 22, 1982

[51] Int. Cl.[3] ..... A63H 11/00

[52] U.S. Cl. ..... 446/288

[58] Field of Search ..... 46/103, 104, 105, 120, 46/121, 149, 150; 446/269, 279, 288, 290

[56] References Cited

U.S. PATENT DOCUMENTS 2,509,135 5/1950 Coplan ..... 46/104 X 4,305,222 12/1981 Terzian et al. ..... 46/104

*Primary Examiner*—F. Barry Shay

[57] ABSTRACT

A skating doll includes a torso upon which are pivotally mounted a head and a pair of legs. The axis of rotation of one leg is angled with respect to the axis of rotation of the other leg so that each leg swings, with respect to the torso, from a rearward, outward position to a forward inward position. The legs include outwardly turned feet supported atop rollers oriented to move in a forward direction in response to the inwardly and forwardly directed force applied to the other leg. Each leg moves out of synchronism with the other and the head is powered for side to side movement so that the weight is on the forwardly moving leg. As a result the doll moves forward in a rolling, sliding, side to side, swaying motion which realistically simulates the movement of a roller or ice skater.

17 Claims, 7 Drawing Figures

SKATING DOLL WITH LEGS HAVING ANGLED PIVOT AXES

BACKGROUND OF THE INVENTION

1. Field of the Invention

This invention relates generally to self-powered skating dolls.

2. Background Art

Dolls achieving forward motion by various mechanisms that alternately move a pair of pivotally mounted members in the form of legs are known in the art. Naturally, skating dolls or dolls which move forwardly on wheeled appendages are also known. For example, U.S. Pat. Nos. 4,305,222, 3,465,473, 3,038,275, 2,243,043, 1,550,309 and 1,261,528 disclose dolls of this type. Despite considerable advances in the general field of walking dolls, theses dolls generally tend to be either highly complicated and therefore expensive or, if more simple, awkward or mechanical in appearance in the course of their movement. It would be highly desirable to devise a relatively simple skating doll which moves in a highly realistic manner.

SUMMARY OF THE INVENTION

The primary object of the present invention is to provide a skating doll which utilizes a relatively simple mechanism to achieve highly life-like skating action.

This and other objects of the present invention are achieved by a skating doll that includes a body with a pair of legs pivotally mounted thereon. Each of the legs is arranged to pivot about an axis angled to the axis of pivotal movement of the other leg. Each of the legs includes a foot adapted for movement in contact with the ground on a line generally perpendicular to the axis of pivotal movement of the leg to which it is not attached. Means are also provided for pivoting the legs about their axes in opposite directions with respect to one another.

DETAILED DESCRIPTION OF THE PREFERRED EMBODIMENT

Figure 1:
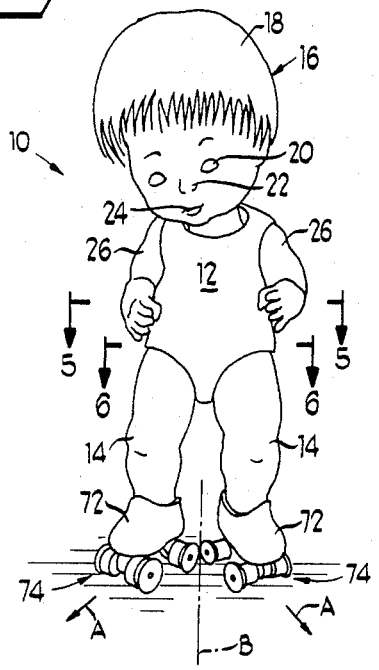
FIG. 1 is a perspective view of one embodiment of the present invention in a first position.
Figure 2:
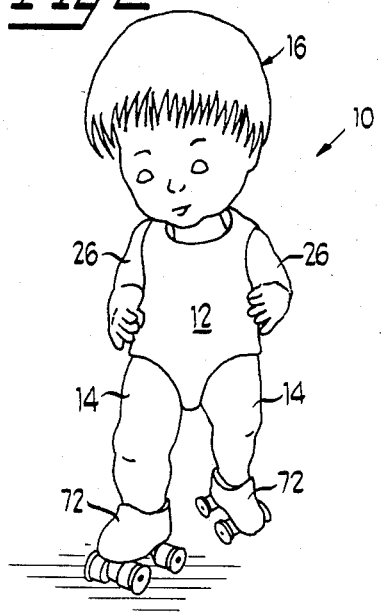
FIG. 2 is a perspective view of the embodiment shown in FIG. 1 in a different position.

Referring to the drawing wherein like reference characters are used for like parts throughout the several views, a skating doll 10 shown in FIGS. 1 and 2 includes a body 12, a pair of limbs or legs 14 pivotally mounted on the lower end of the body 12 and a head 16 pivotally mounted on the upper end of the body 12. The doll may be made by a conventional plastic molding techniques so that each of the various hollow body parts bears a remarkably life-like appearance. To this same end, the head 16 may include hair 18, eyes 20, nose 22, and a mouth 24. In addition a pair of arms 26 may be mounted on the body 12 for a pivotal movement about a lateral axis extending through the shoulders.

Figure 4:
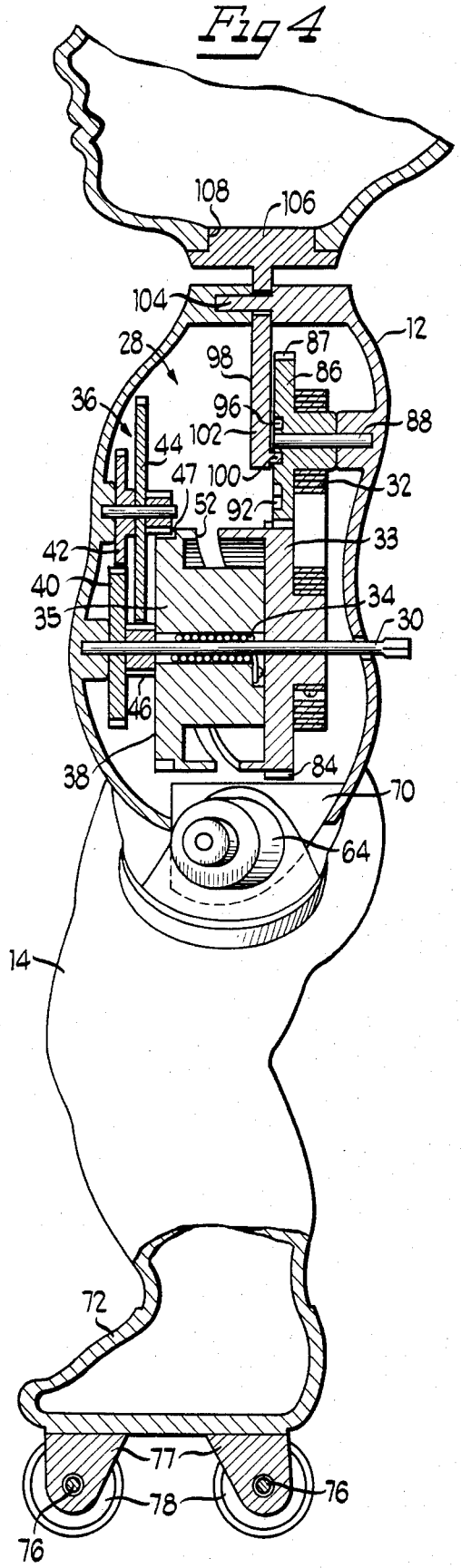
FIG. 4 is a partially cut-away cross-sectional view taken generally along the line 4—4 in FIG. 3.

As shown in FIG. 4, a drive means including a spring motor 28, contained within the body 12, is arranged to power the pivotal motion of the head 16 and legs 14. While a conventional spring motor 28 is illustrated, as variety of other actuating mechanisms may be used including any of a well known variety of electrical and mechanical motors. The illustrated spring motor 28 includes a key-type wind-up shaft 30, a negator spring 32, a coil spring clutch 34, a speed control gear train 36 and a cam gear 38. In a conventional manner the coil spring clutch 34 allows rotary motion of the shaft 30 in one preferred winding direction to be conveyed directly to the negator spring 32 through the winding portion 33 of the gear 38 to tightly coil the spring 32. However, when the spring 32 is allowed to unwind, the clutch 34 engages the speed control portion 35 of the cam gear 38, causing it to rotate at the same speed as the portion 33. The rotation of the cam gear 38 that occurs on unwinding of the spring 32 operates a speed ocntrol gear train 36 including the gears 40, 42, 44 and 46 through the toothed surface 47 of the portion 35. The gear train or linkage 36 operates in a conventional fashion to control the speed of rotation of the cam gear 38 thereby achieving a smooth and even delivery of energy from the spring 32 to the operated elements of the doll 10.

Figure 5:
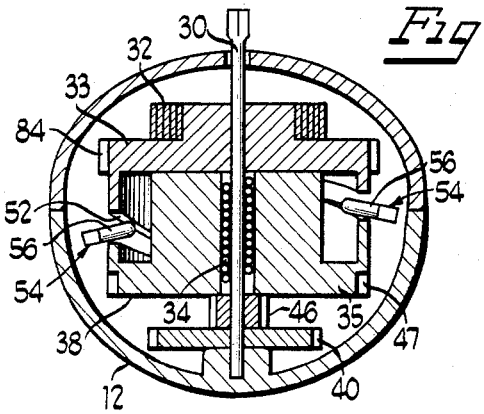
FIG. 5 is an enlarged cross-sectional view taken generally along the line 5—5 in FIG. 1.
Figure 3:
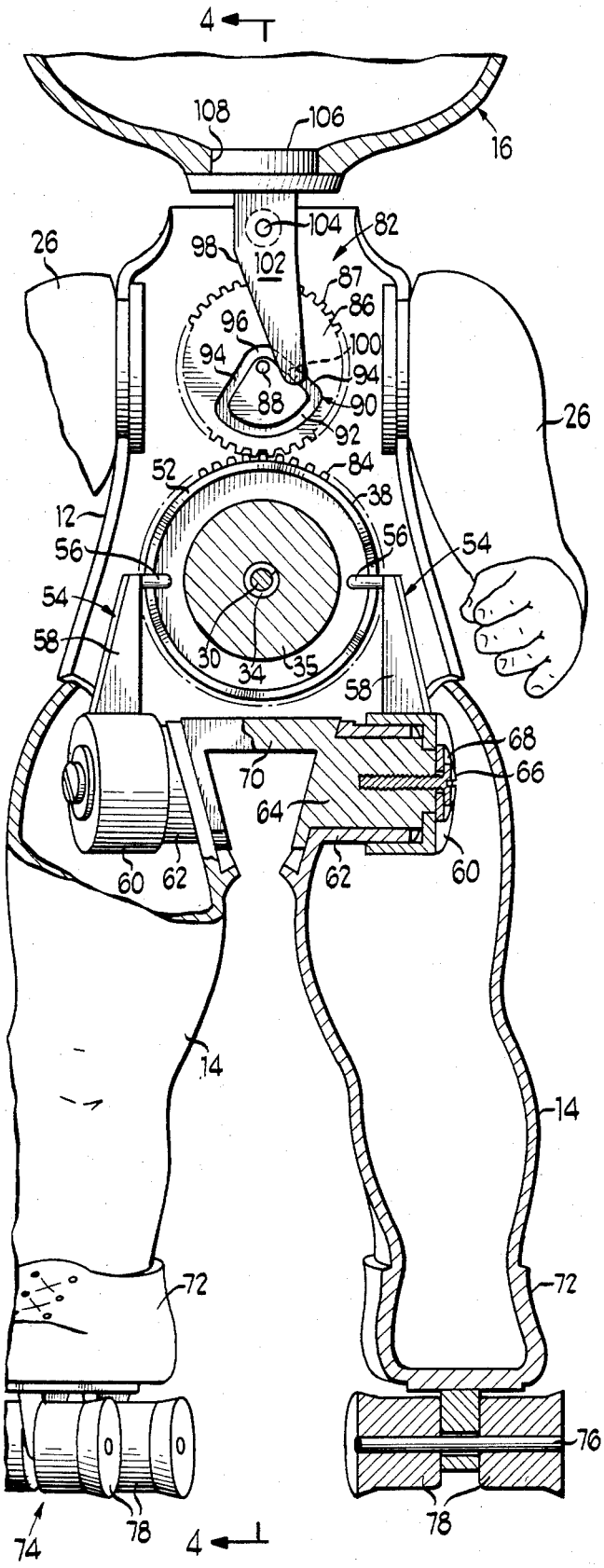
FIG. 3 is an enlarged, partial, partially cut-away, front elevational view of the embodiment shown in FIG. 1.

As shown in FIG. 5, the cam gear 38 includes a broadly sinusoidal peripheral slot 52 which extends completely around the outside of the gear 38, oscillating from a ventral to a dorsal position with respect to the body 12. The slot 52 is engaged at two diametrically opposite points by the cam followers 54. Each cam follower 54 includes a horizontally disposed pin or post 56 and a strut 58 connected on one end to the pin 56 and on the other end to the leg actuating drum 60. As shown in FIG. 3, each leg 14 includes an inwardly directed tubular portion 62 which receives a stub axle 64. Each drum 60 is fixed to its inwardly directed portion 62 but rotates freely with respect to the axle 64. The free rotation between the axle 64 and drum 60 is achieved by the threaded fastener 66 which includes a retainer ring 68. Thus, fore to aft movement of the strut 58 as a result of the arrangement of the pin 56 in the slot 52 results in generally fore to aft pivotal movement of the related leg 14.

Figure 6:
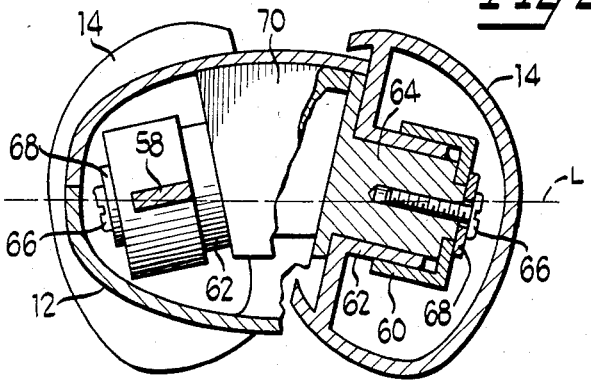
FIG. 6 is an enlarged cross-sectional view taken generally along the line 6—6 in FIG. 1.

However, as shown in FIG. 6, each leg 14, mounted on the body 12 on a downwardly extending portion 70, is arranged at an angle with respect to the lateral axis "L" of the doll 10. This is achieved by arranging each axle 64 at a slight forwardly directed angle, conveniently about 30°, with respect to the lateral axis of the doll 10. As a result, each leg 14 rotates to and from a rearward, outward position and a forward, inward position with respect to the rest of the doll 10 around an axis which dorsally intersects the axis of the other leg 14.

Each of the legs 14 includes a foot 72 supported atop a pair of rollers 74 for rolling movement over a supporting surface. As best shown in FIGS. 3 and 4, each set of rollers 74 includes a pair of parallel central axles 76 mounted on brackets 77, and a pair of wheels 78 mounted on each axle 76. While a roller skating doll is illustrated, an ice skating doll may be implemented by replacing the rollers with ice skates (not shown).

Each foot 72 is canted at a diverging or "duck-footed" angle with respect to the other, the extent of the angle in the illustrated embodiment being approximately 30° from the fore to aft centerline "B" of the doll 10. Thus each foot 72 is oriented generally perpendicularly with respect to the axis of rotation, not of its own leg 14, but with respect to that of the leg 14 to which it is not attached. Since the rollers 74 are arranged for rolling forward movement in the direction (indicated by arrows "A" in FIG. 1) in which their foot 72 is pointed, the rollers 74 preferentially move in a direction generally perpendicular to the axis of rotation of the other leg 14.

A head pivoting mechanism 82 is driven by a geared surface 84 of the cam gear 38 as well as by the negator spring 32. This is achieved through a compound gear 86, encircled by the negator spring 32, with a geared surface 87 which engages the geared surface 84 on the cam gear 38. Rotation of the compound gear 86 around its axle 88 results in the rotation of the generally pie-shaped camming groove 90 on the forwardly facing surface of the gear 86. The camming groove 90 includes a curved peripheral portion 92 joined by a pair of converging almost raidal, straight portion 94 which meet on the opposite side of the axle 88 at a point 96. The groove 90 is engaged by a cam follower 98 including a pin 100 and a strut 102 mounted for pivotal motion on a fore to aft axle 104. The opposite end of the strut 102 is connected to the head 16 by way of the neck piece 106 which is frictionally held within the opening 108 at the base of the head 16. Thus, the head 16 is capable of rotation around the vertical axis with respect to the neck piece 106 in response to manual repositioning while the neck piece is capable of conveying side to side swaying pivotal motion from the strut 102 to the head 16. The shape of the groove 90 results in a side to side motion of the head 16 with the head remaining for a short period in the extreme pivoted position due to the action of the curved portion 92 and the point 96.

The doll 10 is operated in the following manner. Initially the user winds the shaft 30 using a key (not shown). Rotation of the shaft 30 in the proper direction results in the winding of the negator spring 32 and the storage of energy therein. The legs 14 and gear train 36 are unaffected by this winding action since the portions 33 and 35 slip with respect to one another due to the action of the clutch 34. The slot 52 is of sufficient width to enable this relative movement, while trapping the pins 56 and thereby preventing operation of the legs 14.

Subsequent release of the shaft 30 results in unwinding of the negator spring 32, rotation of the cam gear 38 and rotation of the head pivoting mechanism 82. The gear train 36 operates to control the rate of dissipation of the energy stored in the negator spring 32 and results in a smooth and even operation, over a sufficient period of time, of the doll 10.

Figure 7:
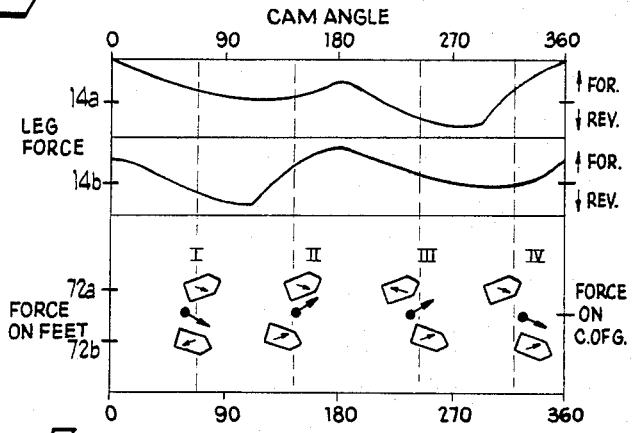
FIG. 7 is a cam diagram showing the force and its direction, applied by the cam to each leg as the cam rotates and also indicates generally the path of movement of the doll's feet in the course of forward movement in response to the cam force.

The rotation of the cam gear 38 drives the cam followers 54 which move in cycles 180° out of phase from one another. As shown in FIG. 7, as the cam gear 38 approaches 90° of angular rotation, the cam gear 38 tends to push the leg **14*a* in a generally forward and inward direction while the other leg 14*b* is pushed in a generally rearward and outward direction (Position I, FIG. 7). The force supplied by the cam followers 54 encourages the leg 14*b* to move in a direction opposed by the arrangement of the rollers 74 on its foot 72. As a result this motion is resisted by the stationary doll 10; however, the generally rearward pivotal force supplied to leg 14*b* is applied through the body 12 to the leg 14*a* resulting in a generally forwardly and outwardly directed rolling movement of the leg 14*a* in the direction of preferred movement of the rollers 74 on the leg 14*b***, from the position "I" to the position "II" in FIG. 7.

Thereafter the forces applied to the legs 14 change in direction so that the leg **14*b* is forced in a direction towards the leg 14*a*. The leg 14*a* skids rearwardly and outwardly initially overcoming the resistance of its rollers 74** to lateral movement (Position III).

At the time when the leg **14*b* initially begins its forward movement, (position I) the motion of the head 16 as a result of the head pivoting mechanism 82 places the weight on the leg 14*a* so that during the initial movement of the leg 14*b* little or no weight is placed on the leg 14*b*. Thereafter, (position II-III) as the leg 14*b* comes abreast of the leg 14*a* the weight distribution is equalized. Then the weight shifts to the leg 14*b* which rolls forwardly on its rollers 74 in response to the force applied by the shift of the weight toward the leg 14*b***.

Since the pivotal motion of the legs 14 is always opposed by the orientation of the rollers 74 on the feet 72 little or no rearward motion of the doll 10 is possible.

The action of the head 16 resulting from the pivoting mechanism 82 is timed to the movement of the legs so that the head 16 is pivoted to the side of the forwardmost leg 14. In this way the action of the head 16 shifts the weight and momentum from one leg to the other so that the rearward or trailing leg is able to slide forwardly, initially in a position slightly off the ground or with little weight on it, avoiding the braking effect inherent in the angled arrangement of the rollers 74 with respect to the foot 72. In addition, due to the design of the camming groove 90, the head 16 remains in its extreme position over the forwardmost leg for a period of time sufficient to enable the movement of the doll to take place. As the trailing leg 14 comes abreast the leading leg 14 the head 16 begins to pivot from a position over the leading leg 14 to a position over the trailing leg 14 as it moves into a leading or forward position. The resulting waltzing movement shown in FIG. 7 simulates the action of a skater in a highly realistic fashion.

It should be understood that numerous modifications of the invention described herein can be devised by those skilled in the art that fall within the spirit and scope of the principles of this invention, even if the invention is not practiced as specifically described herein.

What is claimed and desired to be secured by Letters Patent of the United States is:

1. A self-powered skating doll comprising:

a body;

a drive means including a motor contained within said body;

a pair of legs pivotally mounted on said body, each arranged to pivot relative to said body about a fixed axis arranged to be non-parallel with and to dorsally intersect the axis of pivotal movement of the other leg;

each of said legs including a foot supported atop a skate adapted for preferential movement in contact with a supporting surface along a line generally perpendicular to the axis of pivotal movement of the leg to which it is not attached;

said drive means pivoting said legs about their axes in generally opposite directions with respect to one another;

said drive means including a side to side weight shifting mechanism; and a head pivotally mounted on said body, said mechanism pivoting said head in conjunction with the movement of said legs to place the weight of the doll on the leg which is forwardmost.

2. The doll of claim 1 wherein said skates include rollers attached to the bottoms thereof, each of said rollers being arranged to move preferentially in a direction generally perpendicular to the axis of pivotal movement of the leg to which the roller is not attached.

3. The doll of claim 1 wherein said legs are mounted for rotation about axes oriented at approximately 30° to the lateral axis of said doll.

4. The doll of claim 3 wherein each said skate includes a roller attached to the bottom thereof and the axis of rotation of said roller of one foot is arranged at an angle of approximately 120° with respect to the axis of rotation of the roller of the other foot.

5. The doll of claim 1 wherein each leg is pivotal about only one axis.

6. The doll of claim 1 wherein each leg is pivotal between a rearward, outward position and a forward, inward position, with respect to the remainder of said doll.

7. The doll of claim 1 wherein the drive means includes a cam gear having a geared surface and a peripheral slot and each of the legs is connected to a cam follower which engages the slot at a diametrically opposed point.

8. The doll of claim 1 in which the drive means further includes:

a compound gear having a geared surface which engages the geared surface of the cam gear;

the compound gear also having a camming groove on the facing surface of the gear; and the head is connected to a second cam follower which engages the groove.

9. The doll of claim 1 in which the body has a downwardly extending portion with an axle extending outwardly from each side of the portion, each axle providing a said non-parallel axis for a leg.

10. The doll of claim 1 including a pair of non-driven arms secured generally to the upper end of the body.

11. A skating doll, comprising:

an articulated body having a pair of legs and a head, each pivotally connected to said body;

drive means contained within the body and connected to said legs and head to provide coordinated movement thereof in a manner such that, when the doll skates along a surface, the weight of said doll shifts alternately from one leg to the other, said drive means including a cam means for the coordination of said movement so as to move said doll forward and side-to-side in a properly timed relation;

a leg mounting portion on said body and a leg-receiving axle extending outwardly from each side of said portion in a substantially horizontal plane, each of said axles forming a predetermined acute angle with a vertical plane passing through the portion from side-to-side; and a skate mounted on each leg with the major axis of each skate being directed forwardly and outwardly at an acute angle with respect to a front-to-rear vertical plane passing through the center of the body, whereby the weight shift of the doll to one skate causes the doll to move forwardly and outwardly on the skate.

12. The doll of claim 11 including a pair of non-driven arms secured to the body, generally at the upper end thereof.

13. The doll of claim 11 wherein said skates include rollers attached to the bottom thereof, said rollers each being arranged to move preferentially in a direction generally perpendicular to the axis of the leg-receiving axle of the leg to which the roller is not attached.

14. The doll of claim 11 in which the doll has a lateral axis and the axes of each of the leg-receiving axles is oriented at approximately 30 degrees to the lateral axis of the doll.

15. The doll of claim 14 wherein each skate includes a roller attached to the bottom thereof and the axis of rotation of said roller of one foot is arranged at an angle of approximately 120 degrees with respect to the axis of rotation of the roller of the other foot.

16. The doll of claim 11 in which the cam means includes a cam gear having a geared surface and a peripheral slot and each leg is connected to a respective cam follower, said cam followers engaging the slot at diametrically opposed points.

17. The doll of claim 16 in which the cam means further includes:

a compound gear having a geared surface which engages the gear surface of the cam gear;

the compound gear also having a camming groove on the facing surface of the gear; and the head is connected to a second cam follower which engages the groove.

* * * * *